United States Patent [19]

Ladusaw

[11] 4,445,344

[45] May 1, 1984

[54] REVERSIBLE REFRIGERATION SYSTEM ROTARY COMPRESSOR

[75] Inventor: William T. Ladusaw, Louisville, Ky.

[73] Assignee: General Electric Company, Louisville, Ky.

[21] Appl. No.: 415,064

[22] Filed: Sep. 7, 1982

[51] Int. Cl.[3] ..... F25B 13/00; F04C 18/00

[52] U.S. Cl. ..... 62/324.6; 418/63; 62/508

[58] Field of Search ..... 417/902, 410, 326; 62/324.1, 324.6, 508; 418/63

[56] References Cited

U.S. PATENT DOCUMENTS

| | | | |
|---|---|---|---|
| 368,927 | 8/1887 | Bright . | |
| 902,762 | 11/1908 | Risley . | |
| 1,332,522 | 3/1920 | Shepard . | |
| 2,342,174 | 2/1944 | Wolfert | 62/6 |
| 2,343,514 | 3/1944 | McCormack | 62/115 |
| 2,414,339 | 1/1947 | Skaggs et al. | 257/3 |
| 2,844,945 | 7/1958 | Muffly | 62/160 |
| 2,976,698 | 3/1961 | Muffly | 62/324.6 X |
| 3,514,225 | 5/1970 | Monden et al. | 417/410 |
| 3,723,024 | 3/1973 | Sawai et al. | 137/625.46 X |
| 3,891,358 | 6/1975 | Ladusaw | 418/63 |
| 3,985,473 | 10/1976 | King et al. | 417/315 |
| 4,367,638 | 1/1983 | Gray | 418/63 |

*Primary Examiner*—John J. Vrablik
*Assistant Examiner*—Paul F. Neils
*Attorney, Agent, or Firm*—Frank P. Giacalone; Radford M. Reams

[57] ABSTRACT

A reversible, hermetically-sealed rotary compressor driven by a reversible electric motor for use in a refrigeration system comprising a compressor cylinder, a rotor eccentrically rotatable in the cylinder and a vane dividing the cylinder into interchangeable high and low pressure sides. A switch-over member automatically directs refrigerant into one or the other fluid passageways leading to the refrigeration system as an incident of motor rotation.

5 Claims, 9 Drawing Figures

REVERSIBLE REFRIGERATION SYSTEM ROTARY COMPRESSOR

BACKGROUND OF THE INVENTION

This invention relates to a reversible rotary compressor adapted for use in refrigeration systems, and more particularly as applied to heat pump type air conditioners wherein the operation of the refrigeration system can automatically be switched from cooling operation to heating operation, or vice versa, without using a directional control valve which has been employed in conventional heat pump type air conditioners for changing the direction of flow of a refrigerant passing through a refrigerant circuit.

Conventional compressors for refrigeration systems are generally classified into reciprocation and rotary types. The reciprocating type compressor has the disadvantage that the flowing direction of refrigerant cannot be reversed. The rotary type compressor generally has a suction port only on the suction side and a discharge port only on the discharge side with respect to the pressure transition point. With the suction and discharge directions so fixed, practical use of such a compressor as a reversible compressor is not possible.

One form of a reversible rotary compressor is described in U.S. Pat. No. 2,342,174 wherein a mechanically operated reversing valve is arranged in the compressor casing. The reversing valve includes a member that is mechanically engaged by a member mounted on the motor compressor shaft to shift the valve member when direction of the shaft is reversed. U.S. Pat. Nos. 2,844,945 and 2,976,698 disclose another form of a reversible rotary compressor employing various valves and refrigeration and air conditioning system configurations, and more particularly for defrosting freezer evaporators of two-temperature systems. In U.S. Pat. No. 3,723,024, a reversible rotary compressor is disclosed wherein a movable suction mechanism is provided that is rotated through a predetermined angle so that the suction opening may be shifted to one side or the other of the pressure transition point. In still another prior art patent, U.S. Pat. No. 3,985,473, a reversible rotary compressor is disclosed wherein the single vane automatically controls the flow of fluid through the compressor to maintain it in the same direction through the compressor regardless of the direction of the compressor drive.

SUMMARY OF THE INVENTION

This invention relates to a reversible rotary refrigerant compressor and more particularly to a reversible compressor unit positioned in a hermetic casing. The compressor includes a cylinder having an annular chamber, a rotor eccentrically rotatable with the cylinder with the peripheral surface of the rotor arranged to move progressively into seating relation with successive portions of the annular cylinder. The rotor is drawn by a reversible motor. A blade biased against the rotor divides the cylinder into interchangeable high and low pressure sides. A valve chamber in the cylinder is dimensioned to communicate with at least portions of the high and low pressure sides of the cylinder. Provided in the cylinder is a first fluid passageway between a first opening in the casing and the valve chamber, and a second fluid passageway between a second opening in the casing and the valve chamber.

Positioned in the valve chamber is a switch-over member provided with a first low pressure cavity and a second low pressure cavity. The switch-over member is movable to a first position during rotation of the rotor in one direction to establish a passageway between the first fluid passageway and one side of the cylinder functioning as the low pressure side, and to a second position during rotation of the rotor in the other direction to establish a passageway between the second fluid passageway and the other side of the cylinder functioning as the low pressure side. The switch-over member includes a first high pressure port that communicates with the first fluid passageway when the switch-over member is in its first position and a second high pressure port that communicates with the second fluid passageway when the switch-over member is in its second position.

The switch-over member is further provided with a high pressure valve opening that communicates with the other side of the cylinder functioning as the high pressure side when the switch-over member is in its first position to establish a high pressure passageway between the other side of the cylinder and the second fluid passageway during rotation of the rotor in one direction, and communicating with the one side of the cylinder functioning as the high pressure side when the switch-over member is in its second position to establish a passageway between the one side of the cylinder and the first fluid passageway during rotation of the rotor in the other direction.

DESCRIPTION OF THE PREFERRED EMBODIMENT

Figure 1:
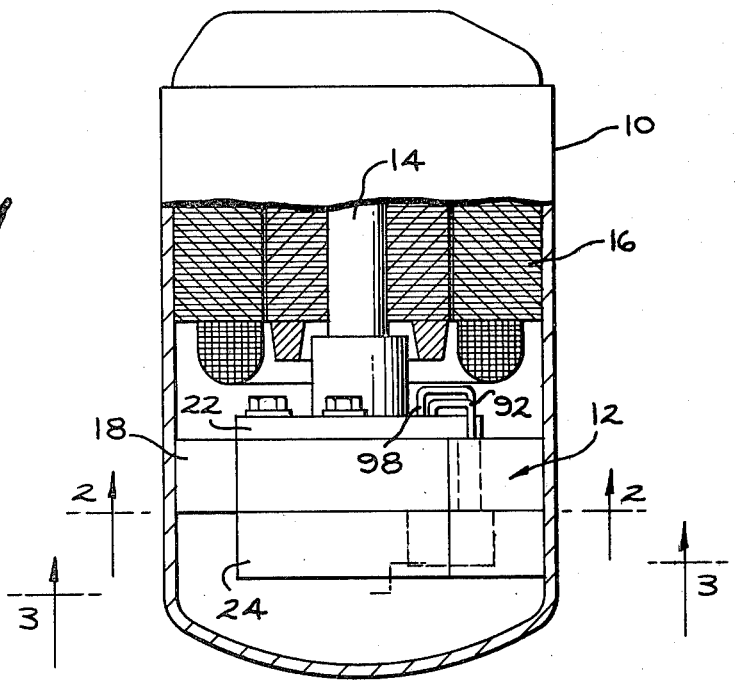
FIG. 1 is an elevational view in cross-section of a rotary compressor embodying the present invention.
Figure 2:
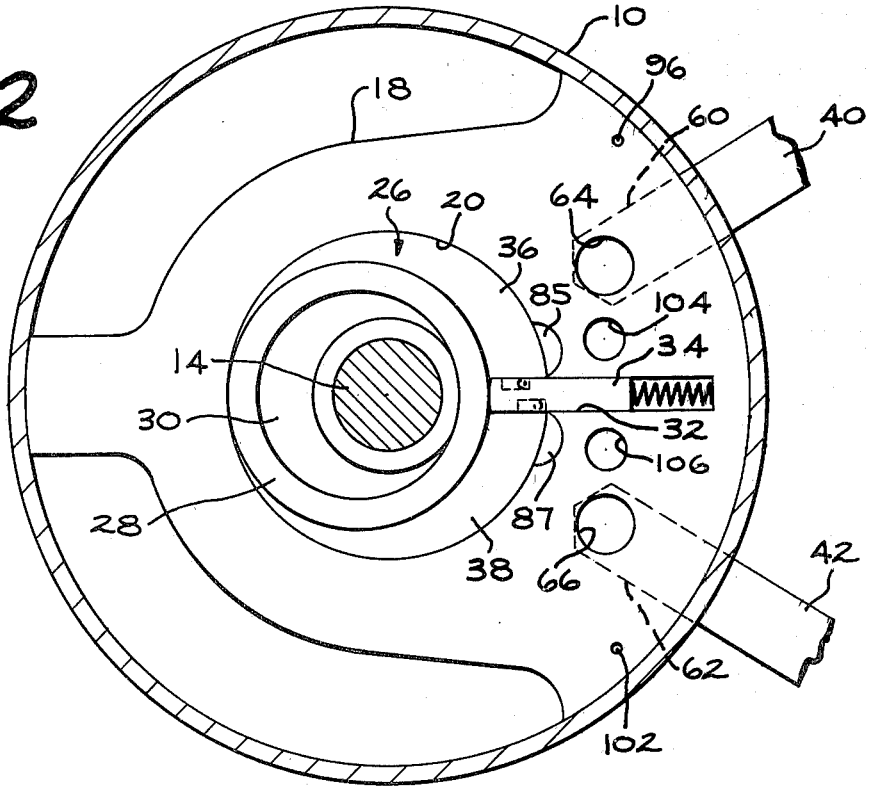
FIG. 2 is a plan view taken along line 2—2 of FIG. 1 with parts removed to show the inside of the cylinder.

With reference to FIGS. 1 and 2 of the drawings, there is shown a hermetic compressor casing 10 in which there is disposed a reversible rotary compressor 12 connected by means of a drive shaft 14 to a reversible electric motor 16.

The compressor includes a cylinder 18 having an inner cylindrical surface 20 which, in combination with upper and lower end plates 22 and 24, defines the annular compression chamber 26. A rotor 28 driven by an eccentric 30 is contained within the chamber 26.

As may best be seen in FIG. 2, the cylinder 18 is provided with a radial slot 32 having slidably disposed therein a blade or vane 34 which is biased into engagement with the peripheral surface of the rotor 28 forming a pressure transition point dividing the chamber 26 into interchangeable high and low pressure sides designated 36 and 38 depending, as will be explained later in detail, on the direction of rotation of the rotor 28.

By the present invention, means are provided in the hermetic compressor for automatically directing the flow of the refrigerant discharge and suction gas interchangeably between lines 40 and 42 by changing the direction of rotation of rotor 28 through motor 16. As will be explained in detail hereinafter, during counterclockwise rotation of the rotor, as viewed in FIGS. 2 and 3, side 36 of the cylinder is the low pressure side and line 40 functions as the suction line with the low pressure refrigerant gas entering side 36 of the compression chamber 26 from the refrigeration system heat exchanger acting as the system evaporator. At this time, side 38 of the cylinder is the high pressure side and line 42 acting as the discharge line carries high pressure refrigerant gas from side 38 of the compression chamber 26 to the refrigeration system heat exchanger acting as the condenser. During rotation of the rotor 28 in the clockwise direction, as viewed in FIGS. 2 and 4, the side 38 of the cylinder is the low pressure side with the low pressure refrigerant gas entering side 38 of the compression chamber 26 from the refrigeration system heat exchanger acting as the system evaporator. At this time, side 36 of the cylinder is the high side and line 40 acting as the discharge line carries high pressure refrigerant gas from side 36 of the compression chamber 26 to the system heat exchanger acting as the condenser.

Figure 3:
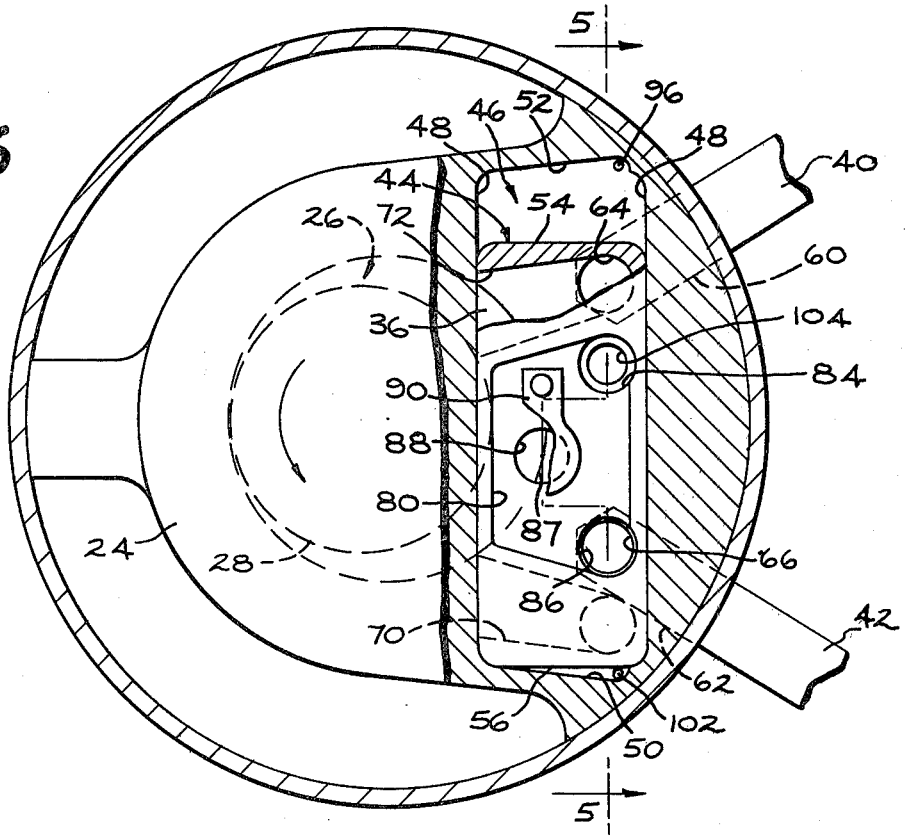
FIG. 3 is a plan view taken along line 3—3 of FIG. 1.
Figure 4:
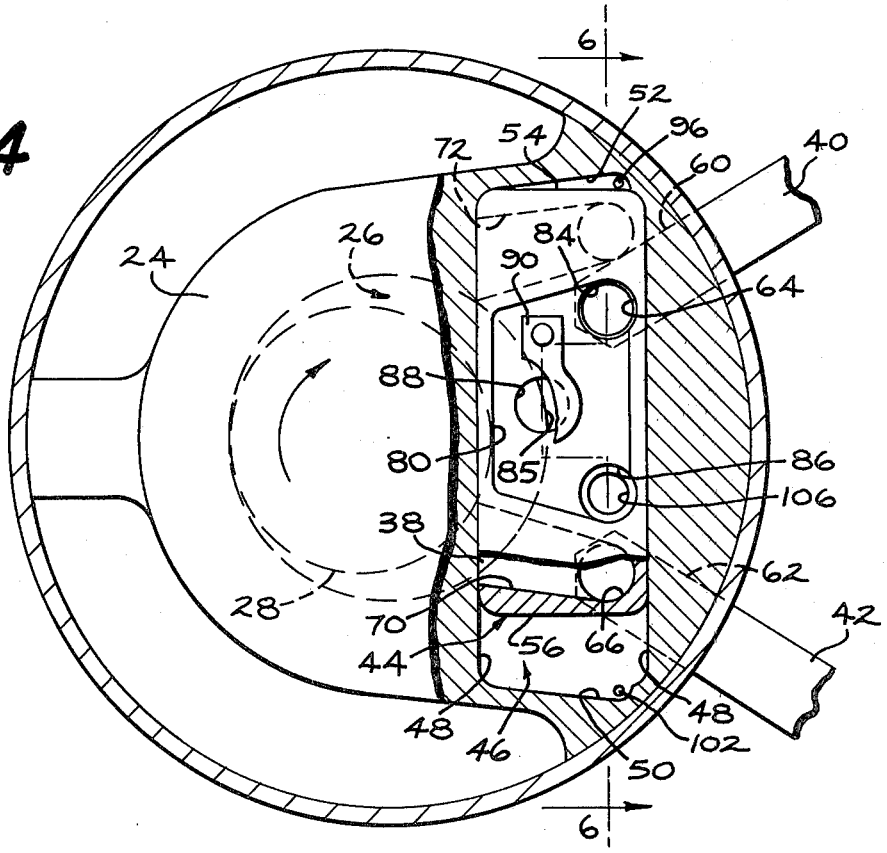
FIG. 4 is a plan view similar to FIG. 2 showing certain parts in another position.
Figure 5:
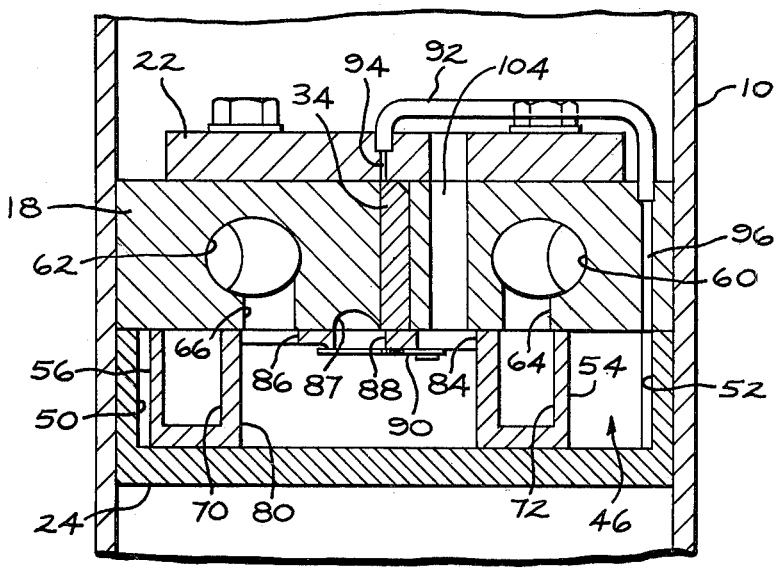
FIG. 5 is an elevational view in cross-section taken along line 5—5 of FIG. 3.
Figure 6:
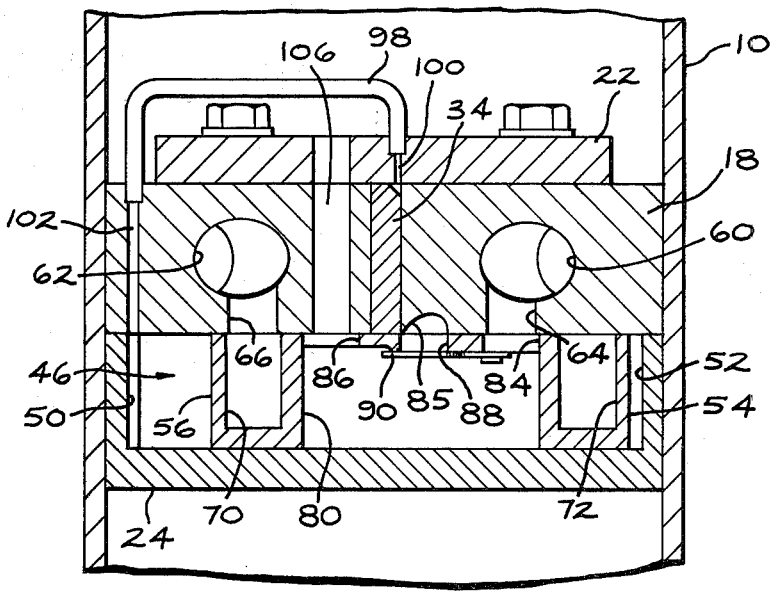
FIG. 6 is an elevational view in cross-section taken along line 6—6 of FIG. 4.
Figure 7:
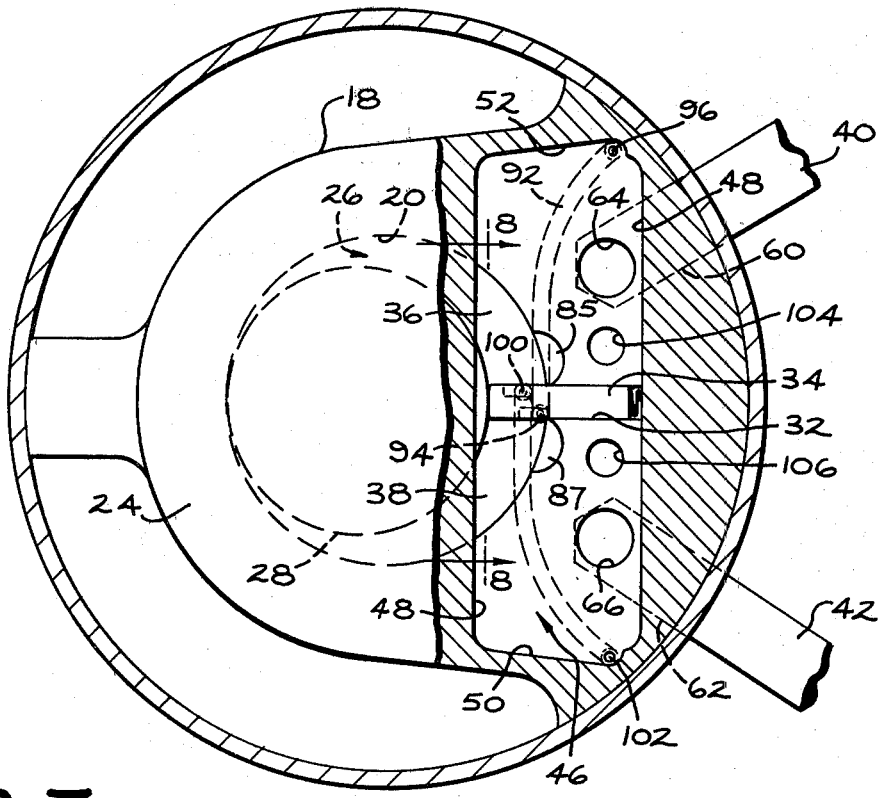
FIG. 7 is a plan view similar to FIGS. 3 and 4 with parts removed.
Figure 8:
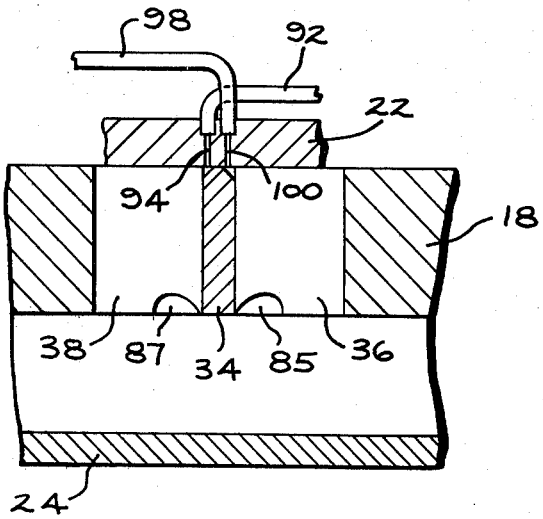
FIG. 8 is a partial sectional view showing a detail of the invention.
Figure 9:
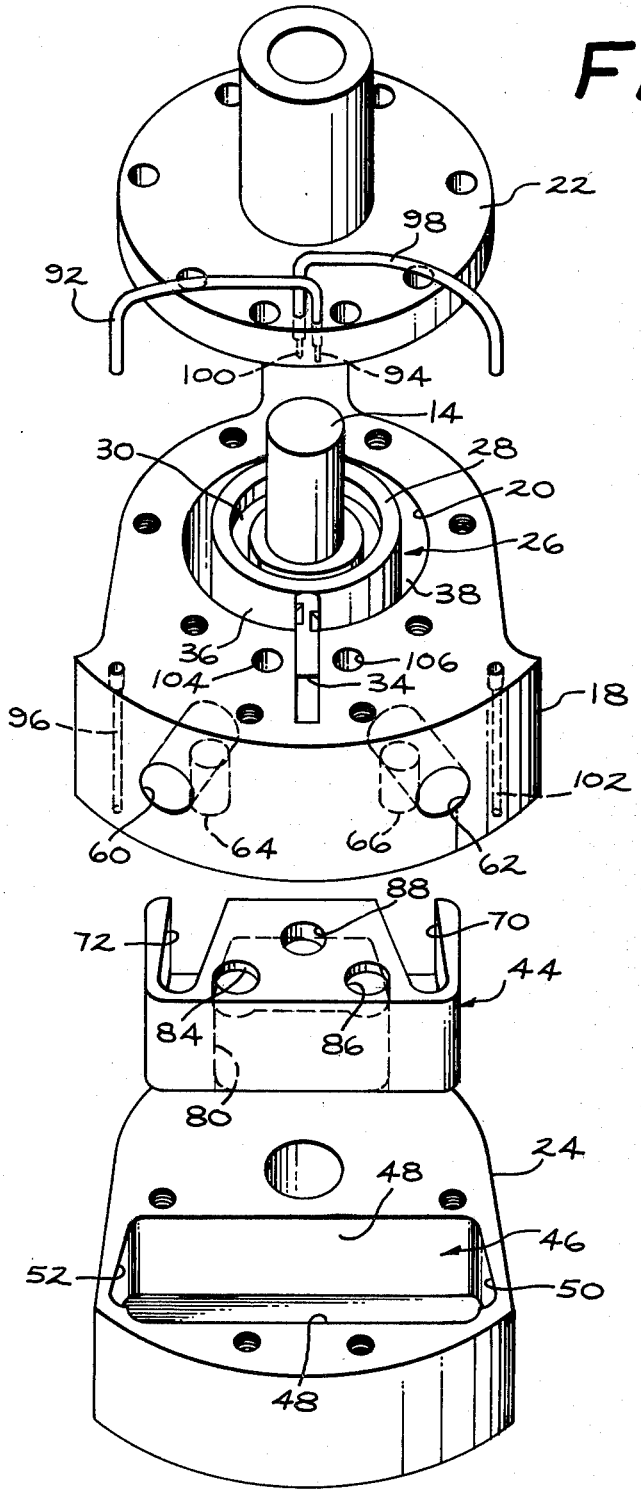
FIG. 9 is an exploded perspective view showing the various parts of the present embodiment.

The above switching between lines 40 and 42 is accomplished through a switch-over member 44. The switch-over member 44 is slidably positioned in a valve chamber or cavity 46 formed in the top surface of plate 24. The cavity 46 in the present instance is substantially rectangular in shape as viewed in FIGS. 3, 4 and 7. The cavity 46 includes side walls 48 and shorter end walls 50 and 52. The cavity 46, as shown in FIG. 7, is exposed at its open end to portions of both sides 36 and 38 of the compression chamber 26 in the area adjacent the vane 34. The switch-over member 44 is also rectangular in shape and dimensioned so that its side walls slide against the side walls 48 of cavity 46 and its top and bottom walls slide against the bottom wall of the cylinder and bottom wall of the cavity 46 in a piston-like manner. The sliding movement of the switch-over member 44 is limited by the end walls 50, 52 of the cavity 46. In operation, the switch-over member 44 moves from a first position as shown in FIG. 3 during rotation of the rotor in a counterclockwise direction with one of its end walls 56 adjacent the wall 50 to a second position as shown in FIG. 4 during rotation of the rotor in a clockwise direction with the other of its end walls 54 adjacent the end wall 52 of cavity 46. The manner in which switch-over member 44 is moved from one position to the other as an incidence of rotational direction of the rotor 28 will be fully explained hereinafter. With reference to FIGS. 2-7, it will be seen that the lines 40 and 42 are connected to passageways 60 and 62, respectively. The passageways 60 and 62 are formed in the cylinder 18 and terminate at apertures 64 and 66, respectively. The apertures 64 and 66 are positioned in the cavity 46 and interact with the switch-over member 44 in a manner to be explained fully hereinafter.

The refrigerant flow path through the low pressure side of the compressor is established in the following manner. Formed in the switch-over member 44 adjacent the ends 54 and 56 are two low pressure cavities 70 and 72, respectively, FIGS. 3-6. The cavities 70, 72 are in effect channels that extend to one side wall 48 of cavity 46 and are exposed to the compression chamber 26 of cylinder 18. With reference to FIG. 3, it will be seen that during counterclockwise rotation of the rotor 28, the closed end of cavity 72 is aligned with the aperture 64 of the passageway 60. The other or open end of cavity 72 is aligned with or exposed to side 36 of the chamber 26. In this counterclockwise rotation of the rotor 28, side 36 is the low pressure side, and the passage completed from side 36 to line 40 through the channel 72 is in fact now the suction passage.

With reference to FIG. 4, it will be seen that during clockwise rotation of the rotor 28, the closed end of cavity 70 is aligned with aperture 66 of the passageway 62. The other or open end of cavity 70 is aligned with or exposed to side 38 of chamber 26. In this clockwise rotation of the rotor 28, side 38 is, as mentioned above, the low pressure side and the passage completed from side 38 to line 42 through the chamber 70 is in fact now the suction passage.

The refrigerant flow path through the high pressure side of the compressor is established in the following manner. The switch-over member 44 further includes a high pressure central cavity 80 (FIGS. 3-6) formed in the bottom wall of the member 44 in the area between the cavities 70, 72. Formed in the top wall of the member 44 and communicating with cavity 80 are two high pressure openings 84 and 86. Also formed in the bottom wall of member 44 and communicating with cavity 80 is a high pressure discharge opening 88. A portion of the high pressure discharge opening 88 communicates with or is exposed alternatively to sides 36 and 38 of the compression chamber 26, as will now be explained. Mounted over the opening 88 is a suitable valve 90 for assuring proper compression of the gas issuing through opening 88 and for preventing reverse flow of gas back into the compression chamber 26. To insure that an appropriate amount of high pressure gas will flow through discharge opening 88, the cylinder 18, as shown in FIGS. 2, 5, 7 and 8, is provided with suitable grooves 85 and 87 positioned in sides 36 and 38, respectively, of chamber 26. The opening 88 communicates with groove 87 during rotation of the rotor 28 in the counterclockwise direction, as shown in FIGS. 3 and 5. The opening 88 communicates with groove 85 during rotation of the rotor 28 in the clockwise direction, as shown in FIGS. 4 and 6.

During rotation of the rotor 28 in the counterclockwise rotation, as viewed in FIG. 3, it will be seen that the high pressure opening 86 in central cavity 80 is in alignment with the aperture 66. In this instance, high pressure gas passing through opening 88 from high side 38 of chamber 26 is discharged through passageway 62 to line 42. As mentioned previously, at the same time suction gas from line 40 enters aperture 64 and through cavity 72 it enters the low side 36 of chamber 26 completing the compression cycle during counterclockwise rotation of the rotor 28. During rotation of the rotor 28 in the clockwise rotation as viewed in FIG. 4 it will be seen that the high pressure opening 84 in the central cavity 80 of member 44 is in alignment with aperture 64. In this instance, high pressure gas passing through opening 88 from the high side 36 of chamber 26 is conducted to line 40. As mentioned previously, at the same time suction gas from line 42 enters aperture 66 and through cavity 70 it enters low side 38 of the chamber 26, completing the compression cycle during the clockwise rotation of the rotor 28.

By the present invention, means are provided for automatically shifting the switch-over member 44 between its operating positions. To this end, as seen in FIGS. 5–7, a first conduit 92 is connected at one end to an opening 94 on side 38 of chamber 26 and at its other end to an opening 96 in cavity 46 adjacent the end wall 52. In operation, as the rotor 28 rotates in the counterclockwise direction, as indicated in FIG. 3, a portion of the high pressure gas from side 38 of chamber 26 is introduced into cavity 46 through opening 96 adjacent wall 52. The action of the high pressure gas in the cavity 46 between wall 52 and wall 54 of member 44 causes switch-over member 44 to move to the position shown in FIG. 3 wherein the line 40 functions as the low pressure suction line and the line 42 functions as the high pressure discharge line, as explained above. A second conduit 98 is connected at one end to an opening 100 on side 36 of chamber 26 and at its other end to an opening 102 in the cavity 46 adjacent the end wall 50. In operation, as the rotor 28 rotates in the clockwise direction, as indicated in FIG. 4, a portion of the high pressure gas from side 36 of chamber 26 is introduced into the cavity 46 through opening 102 adjacent the wall 50. The action of the high pressure gas in cavity 46 between wall 50 and wall 56 of member 44 causes switch-over member 44 to move to the position shown in FIG. 4 wherein the line 40 functions as the low pressure suction line and the line 42 functions as the high pressure discharge line, as explained above. It should be noted that when conduit 92 introduces high pressure gas into cavity 46 through opening 96, opening 102 through conduit 98 is exposed to suction pressure, and, alternatively, when conduit 98 introduces high pressure gas into cavity 46 through opening 102, opening 96 through conduit 92 is exposed to suction pressure to insure $\Delta p$ force in each instance.

Means are also provided by the present invention to maintain the interior of the casing at high pressure. To this end, a pair of conduits 104 and 106 are formed in and extend from the cavity 46 through the cylinder 18 and upper end plate 22 into the interior of the casing 10. In the position of member 44 as shown in FIGS. 3 and 5, during counterclockwise rotation of rotor 28 the opening 84 of member 44 aligns with conduit 104 and a portion of the high pressure gas passing through opening 88 is conducted through conduit 104 into the interior casing 10. In the position shown in FIGS. 4 and 6, during clockwise rotation of rotor 28 the opening 86 of member 44 aligns with conduit 106 and a portion of high pressure gas passing through opening 88 is conducted through conduit 106 into the interior casing 10. Accordingly, a portion of the high pressure gas passing through opening 88 in both rotational directions of rotor 28 is discharged into the interior of casing 10 and thereby maintains it at high pressure.

In summary, by changing rotational direction of the rotor 28 through action of the selectively reversibly motor 16, the switch-over member 44 automatically aligns appropriate passageways which causes the lines 40, 42 to interchangeably function as suction or discharge lines as a function of rotational direction of the rotor 28.

The foregoing is a description of the preferred embodiment of the apparatus and method of the invention, and it should be understood that variations may be made thereto without departing from the true spirit and scope of the invention as defined in the appended claims.

What is claimed is:

1. A reversible rotary refrigerant compressor comprising:

a hermetic casing containing a high pressure refrigerant gas;

a compressor unit positioned in said casing, including a cylinder having an annular chamber, spaced upper and lower end walls connecting with said cylinder and enclosing said annular cylinder, a rotor eccentrically rotatable within said cylinder with the peripheral surface of said rotor arranged to move progressively into sealing relation with successive portions of said annular cylinder;

a reversible motor in said casing having a shaft thereon extending into said unit for driving said rotor;

a radial slot in said cylinder communicating with said chamber;

a blade slidably positioned in said radial slot;

means biasing said blade against said rotor for following said rotor, thereby to divide said cylinder into interchangeable high and low pressure sides;

a valve chamber in said cylinder communicating with at least portions of said high and low pressure sides of said annular cylinder;

a first fluid passageway communicating between a first opening in said casing and said valve chamber;

a second fluid passageway communicating between a second opening in said casing and said valve chamber;

a switch-over member movable between end walls of said valve chamber, said switch-over member having a first low pressure cavity and a second low pressure cavity, means responsive to rotor rotation in one direction for moving said switch-over member to a first position during rotation of said rotor in said one direction wherein a passageway is established through said first cavity between said first fluid passageway and one side of said cylinder functioning as the low pressure side, and means responsive to rotor rotation in the other direction for moving said switch-over member to a second position during rotation of said rotor in said other direction wherein a passageway is established through said second cavity between said second fluid passageway and the other side of said cylinder functioning as the low pressure side;

a first high pressure port in said switch-over member communicating with said first fluid passageway when said switch-over member is in its first position;

a second high pressure port in said switch-over member communicating with said second fluid passageway when said switch over member is in its second position; and a high pressure valved opening in said switch-over member being in communication with said other side of said cylinder functioning as the high pressure side when said switch-over member is in its first position to establish a high pressure passageway between said other side of said cylinder and said second fluid passageway during rotation of said rotor in said one direction, and being in communication with said one side of said cylinder functioning as the high pressure side when said switch-over member is in its second position to establish a passageway between said one side of said cylinder and said first fluid pasageway during rotation of said rotor in said other direction.

2. The reversible rotary compressor recited in claim 1 further including means for moving said switch-over member having a first bleed conduit connected between said value chamber and said other side of said cylinder functioning as the high pressure side for moving said switch-over member to its first position during rotation of said rotor in said one direction, and a second bleed conduit connected between said valve chamber and said one side of said cylinder functioning as the high pressure side for moving said switch-over member to its second position during rotation of said rotor in said other direction.

3. The reversible rotary compressor recited in claim 2 wherein said second bleed conduit is connected between said valve chamber and said one side of said cylinder functioning as the low pressure side when said first bleed conduit is connected between said valve chamber and said other side of said cylinder functioning as the high pressure side to insure a $\Delta p$ force.

4. The reversible rotary compressor recited in claim 3 wherein said first bleed conduit is connected between said valve chamber and said other side of said cylinder functioning as the low pressure side when said second bleed conduit is connected between said valve chamber and said one side of said cylinder functioning as the high pressure side to insure a $\Delta p$ force.

5. The reversible rotary compressor recited in claim 3 further including means for maintaining said casing at high pressure, a first high pressure conduit in said cylinder communicating between said casing and said first high pressure port in said switch-over member when said switch-over member is in its first position for directing high pressure refrigerant gas into said casing during rotation of said rotor in one direction, and a second high pressure conduit in said cylinder communicating between said casing and said second high pressure port in said switch-over member when said switch-over member is in its second position for directing high pressure refrigerant gas into said casing during rotation of said rotor in the other direction.

* * * * *